US005278721A

United States Patent [19]

Fenster

[11] Patent Number: 5,278,721

[45] Date of Patent: Jan. 11, 1994

[54] ELECTRIC CHARGE DISCHARGE AND DISSIPATION DEVICE

[75] Inventor: Raynard M. Fenster, Pueblo, Colo.

[73] Assignee: Electrostatic Devices, Inc., Pueblo, Colo.

[21] Appl. No.: 949,451

[22] Filed: Sep. 22, 1992

Related U.S. Application Data

[63] Continuation of Ser. No. 591,790, Oct. 2, 1990.

[51] Int. Cl.[5] ..... H05F 3/00

[52] U.S. Cl. ..... 361/218; 244/1 A

[58] Field of Search ..... 361/222, 212-220; 244/1; 174/5

[56] References Cited

U.S. PATENT DOCUMENTS

| | | | |
|---|---|---|---|
| 2,466,024 | 4/1949 | Hall | 361/218 |
| 2,466,311 | 4/1949 | Hall | 361/218 |
| 4,602,310 | 7/1986 | Fenster | 361/212 |
| 4,823,228 | 4/1989 | Bittner | 361/218 |
| 4,998,178 | 5/1991 | Weiss | 361/220 |

FOREIGN PATENT DOCUMENTS

| | | | |
|---|---|---|---|
| 0474580 | 6/1951 | Canada | 361/218 |
| 0651743 | 4/1951 | European Pat. Off. | 361/218 |

*Primary Examiner*—Howard L. Williams
*Assistant Examiner*—Richard T. Elms
*Attorney, Agent, or Firm*—Sheridan Ross & McIntosh

[57] ABSTRACT

A device for dissipating and discharging undesired electric charges, especially from airplanes. The device is formed from nonmetallic conductive material, such as carbon loaded plastic, and comprises a number of regions having varying conductivities. A region at a first end where the device is connected to a mass to be discharged has a lower conductivity than a region at a second end. The device includes a coating comprised of insulating material, which coats the entire surface of the nonmetallic material except for a portion of the nonmetallic material on the second end of the device. A magnetic flux is created which pulls charges from the mass through the device. The charge is in part dissipated in the nonmetallic material and is in part discharged into the air through the exposed portion.

20 Claims, 1 Drawing Sheet

ELECTRIC CHARGE DISCHARGE AND DISSIPATION DEVICE

This is a continuation of application Ser. No. 07/591,790, filed Oct. 2, 1990.

BACKGROUND OF THE INVENTION

1. Field of the Invention

The present invention relates to an apparatus for dissipating and discharging electrical charges from bodies which cannot be connected to ground directly. More particularly, the present invention is directed to a non-metallic apparatus for dissipating and discharging electrical charges, such as static electricity or charges caused by electrical overstress or lightning, from an aircraft.

2. Description of the Related Art

In recent years, sophisticated electronic equipment has found more and more uses on a wide variety of devices. For example, sophisticated aircraft and motorized vehicles are nearly completely reliant on electronic equipment provided therein. Further, some aircraft and motorized vehicles serve as convenient containers for electronic devices which perform a wide variety of functions not related to the operation of the vehicle. However, the very advances which have enabled the inclusion of sophisticated electronic equipment onto such vehicles has rendered such electronic equipment quite susceptible to breakdown or failure due to electrostatic and other undesired electrical charges. Such a failure or breakdown can be catastrophic on certain vehicles, such as aircraft.

Aircraft are especially susceptible to the build-up of electrostatic charge, lightning strikes and electrical overstress. Technological advances have permitted aircraft to fly at any time day or night and in all kinds of weather. However, the communication, radar, navigation and control systems which have revolutionized flying are easily affected by undesired electric charges. Various weather conditions can cause radio frequency interference, electromagnetic interference, and electromagnetic pulses, which can degrade or reduce the effectiveness of the systems. Lightning strikes can be especially devastating. Accordingly, dissipation and discharge of undesired electrical charges are major concerns in the aircraft industry.

In this regard, conductive wicks have been developed for discharging accumulated electrostatic charge from aircraft. These wicks are designed so that charge flows from the moving body into the wick and is discharged therefrom. However, the wicks presently in use have a number of drawbacks. These wicks act as independent circuits, requiring a relatively high level of charge to build up in the moving body before discharge is initiated therethrough. To reduce the charge level necessary to initiate discharge, wicks have become part of more complex discharge systems which include specialized circuitry for initiating discharge. This results in more complex wicks, which are more expensive to produce and more prone to failure.

SUMMARY OF THE INVENTION

Accordingly, one object of the present invention is to provide a simplified device for dissipating and discharging undesired electrical charges from a body.

Another object of the present invention is to provide a device for limiting damage and malfunctioning of electronic and electromechanical systems on a body due to the accumulation of electrostatic charge, lightning and electrical overstress.

Yet another object of the present invention is to provide a relatively light weight and easy to manufacture device for discharging and dissipating undesired electric charges.

A still further object of the present invention is to provide a device for discharging and dissipating electric charges which can be added onto or built into a body.

A further object of the present invention is to provide a device for minimizing the discharge threshold and the corona coupling area while maximizing noise reduction and positive electrical contact.

Other objects and advantages of the present invention will be set forth in part in the description and drawings which follow, and, in part, will be obvious from the description, or may be learned by practice of the invention.

As embodied and broadly described herein, an apparatus for dissipating and discharging electric charge from a mass according to the present invention includes a nonmetallic body having first and second ends, the first end being connected to the mass and having a first conductivity, the first conductivity being less than a second conductivity of the second end. The apparatus may also include a insulating layer formed over the body except for a portion of the body proximate to the second end. Preferably, the nonmetallic body is composed of conductive plastic.

The present invention will now be described with reference to the following drawings, in which like reference numbers denote like elements throughout.

DESCRIPTION OF THE PREFERRED EMBODIMENT

Aircraft are one type of mass which are especially susceptible to the problems associated with undesired electric charge. An aircraft 10 having conductive wicks 12 attached thereto is illustrated in FIG. Typically, at least one conductive wick 12 is attached to the trailing edge of a wing of the aircraft 10. The wicks 12 can also be attached to other trailing edges of the aircraft 10. Such an arrangement is preferred in order not to degrade the aerodynamic performance of the aircraft.

Figure 1:
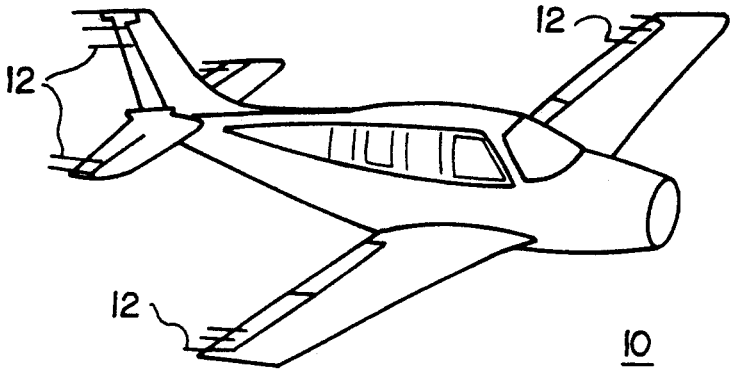
FIG. 1 is a perspective view of an aircraft employing the device according to the present invention.
Figure 2:
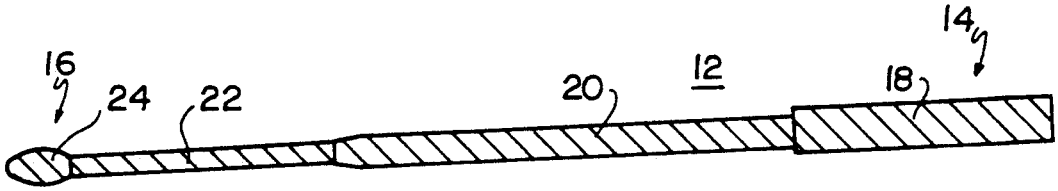
FIG. 2 illustrates a cross-section of the device according to the present invention.
Figure 3:
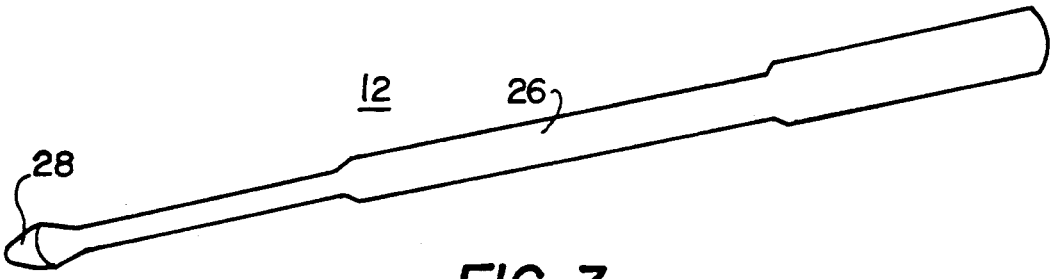
FIG. 3 is a perspective view of the device according to the present invention.

Given these considerations, aircraft wicks are typically cylindrical in shape. Although this characteristic is not required, FIGS. 2 and 3 illustrate a wick 12 according to the present invention which has this cylindrical characteristic. The wick 12 is illustrated in cross-section in FIG. 2 and in perspective in FIG. 3.

The wick functions to draw undesired electric charge from the associated mass which has built up or is otherwise contained in the mass and to dissipate and/or discharge the electric charge. The wick according to the present invention performs this function in a unique way. Heretofore, most wicks have included metallic materials to at least provide the necessary conduction of the electric charge from the associated mass. On mobile vehicles, traditional "grounding" is not possible. Wicks typically create an electrical pathway from the associated mass and discharge directly into the air. The electrical pathway in the present wick 12 is created in a unique way using conductive material to create a closed loop magnetic field extending in the interior of the wick 12. The material is preferably nonmetallic, although it should be understood that metallic materials having the properties discussed below may be employed, and the material is preferably mostly enclosed or coated with an insulating material. The electrical pathway formed thereby is in a region of relatively high magnetic flux density. The conductive materials are of sufficient internal and surface resistivity so as to dissipate electrical overstress, charge from lightning and electrostatic charge under the influence of the magnetic field, and to discharge any charge as necessary to the air through a non-insulated portion of the body of the wick 12.

Referring now specifically to FIG. 2, the wick 12 includes a coupling device (not shown) in its right or first end 14 for coupling the wick to a mass from which the wick will draw the charge and through which the charge will flow to the wick. Aircraft typically include bolts on trailing edges of wings and the like for the mounting of wicks, and a wick according to the present invention will typically include a threaded socket in the first end 14 for enabling easy mounting of the wick 12 to existing aircraft. Alternatively, the wick 12 can be built into an aircraft during production and permanently mounted to the aircraft using other means. Charge enters the wick 12 from the mass through the coupling device.

In order to provide an appropriate electrical pathway, the wick 12 includes at least two distinct regions of different conductivities. The wick 12 of FIG. 2 includes four such regions 18, 20, 22, 24, although different numbers and configurations of regions are possible. These four regions are consecutive from the first end 14, which is in a first region 18, to a left or second end 16, which is in a fourth region 24. The highest resistivity and lowest conductivity of the regions 18, 20, 22, 24 is found in the first region 18. Resistance decreases and conductance increases in each consecutive region toward the second end 16. In this manner, electric charges are drawn from the mass through the wick 12 toward the second end 16.

Such a wick can be formed a number of ways. Recent improvements in multi-component injection technology now permit a single unitary resin, plastic or like body to be formed through injection molding using this technique, a body according to the present invention having different properties in different portions thereof can be formed. Alternatively, it is possible that the body of the wick 12 can comprise a plurality of components having the appropriate characteristics which are glued or somehow otherwise joined together. Polypropylene is preferred as the basic component of the body of the wick 12, although other nonmetallic conductors may also be used. The polypropylene in each region of the wick 12 is loaded with differing quantities of carbon to provide the desired electrical property in each region 18, 20, 22, 24. As is known, the larger the percentage of carbon in the resin, the greater the conductivity.

As illustrated in FIG. 3, in a preferred embodiment, the wick 12 is almost entirely coated or enclosed by an insulating layer 26. The insulating layer 26 is preferably capable of withstanding the large temperature ranges and atmospheric conditions to which the wick 12 will be exposed in use with aircraft. A CPVC resin or ABS insulating material, which is available from the Borg-Warner Company, may be employed as the insulating layer 26. The insulating material 26 does not cover a portion 28 of the fourth region 24 at the second end 16 of the wick 12. Charge pulled through the wick 12 is discharged into the air through the noncoated portion 28, as will be explained below. By forming the wick 12 from these materials, the wick should be flexible, which is a desired characteristic in aerodynamic applications.

In designing the wick 12, the overall dimensions can be selected to assist in producing magnetic flux to draw electric charge from the associated mass. According to a preferred embodiment, the wick 12 is approximately 8⅛ inches long and has a thickness of no greater than 1 inch at any portion. The first, second and third regions 18, 20, 22 are generally cylindrical in shape and decrease in thickness from the first region 18 at the first and to the far end of the third region 22. In the preferred embodiment, the length of the first region 18 is approximately 2 inches, the length of the second region 10 is approximately 3½ inches, the length of the third region 22 is approximately 2⅛ inches, and the length of the fourth region is approximately ½ inch. The fourth region 24 at the second end 16 is somewhat bulbous in shape. However, a number of different shapes are possible as long as the desired electrical properties, as discussed above, exist in the wick 12 to dissipate and discharge electrical charge from a mass.

As mentioned above, in a preferred embodiment, the first region 18 is formed from polypropylene which is carbon loaded so that it has the lowest conductivity of the four regions, while the fourth region has the highest conductivity, being formed from polypropylene with a sufficient carbon concentration to make it the most conductive region. For example, in the preferred embodiment, the surface resistivity of the first region 18 can range from $10^6$ to $10^5$ ohms per square centimeter, while the volume resistivity can be $10^5$ to $10^4$ ohms per cubic centimeter. The surface resistivity of the second region 20 can be $10^5$ to $10^4$ ohms per square centimeter, while the volume resistivity can be $10^4$ to $10^3$ ohms per cubic centimeter. The surface resistivity of the third region 22 can range from $10^4$ to $10^3$ ohms per square centimeter, while the volume resistivity can range from $10^3$ to $10^2$ ohms per cubic centimeter. The fourth region 24 has the highest conductivity. The surface resistivity of the uncovered portion of the fourth region 24 can be approximately $10^2$ ohms per square centimeter.

It has been found that using an insulated polypropylene wick having approximately these dimensions and these conductivities, a magnetic flux is created in the middle of the wick 12 which essentially pulls electric charge from the associated mass through the wick 12 at an efficiency of many hundreds of times superior to that of prior wicks. The potential in such a wick 12 increases toward the second end 16, as does the speed of the charge flowing through the wick 12. The conductive material is of a sufficient internal and surface resistivity to help to dissipate electrical overstress, electrostatic charges, and charge from lightning under the influence of the magnetic field, while undesired charge which is not dissipated in the wick 12 will be discharged through the exposed portion 28 of the fourth region 24 into the air It has been found that wicks having proportions and conductivities similar to those described above will provide similar results. However, it is anticipated the principles discussed above can be applied to develop electric charge dissipation and discharge devices having a wide variety of shapes which still provide similar results.

While one embodiment of the invention has been discussed, it will be appreciated by those skilled in the art that various modifications and variations are possible without departing from the spirit and scope of the invention.

What is claimed is:

1. A device for dissipating and discharging electric charge from a mass which is not directly connected to ground, comprising a body having a first end for interconnection to the mass and a second end for discharging electric charge to the ambient atmosphere, the first end having a first conductivity less than a second conductivity of the second end of said body, wherein electric charge is drawn from said mass to the second end and discharged to the ambient atmosphere.

2. A device for dissipating and discharging electric charge according to claim 1, further comprising an insulating layer formed over said body except for a portion of said body proximate to the second end.

3. A device for dissipating and discharging electric charge according to claim 1, wherein the body is composed of conductive plastic.

4. An apparatus for dissipating and discharging electric charge from a mass which is not directly connected to ground, comprising:

a non-metallic body having a plurality of regions including a first end region coupled to the mass and second end region for discharging electric charge tot he ambient atmosphere, wherein each of the plurality of regions has a substantially uniform conductivity and the conductivity of each successive region increases from the first end region to the second end region; and an insulating layer covering said body except for an exposed portion of the second end portion.

5. An apparatus for dissipating and discharging electric charge according to claim 4, wherein each of the regions is loaded with a quantity of carbon so as to produce a desired conductivity therein.

6. An apparatus for dissipating and discharging electric charge according to claim 4, wherein the regions include said first end region having a first conductivity, a first intermediary region adjoining the first end region and having a second conductivity, a second intermediary region adjoining the first intermediary region and having a third conductivity, and said second end region having a fourth conductivity and adjoining the second intermediary region, the first conductivity being less than the second conductivity, the second conductivity being less than the third conductivity, and the third conductivity being less than the fourth conductivity.

7. An apparatus for dissipating and discharging electric charge according to claim 6, wherein the exposed portion of said body is in the fourth region.

8. The device of claim 6, wherein said second end region widens from a first portion adjacent said second intermediary region to a second thicker portion and narrows from said second thicker portion to a substantially pointed free end.

9. The device of claim 6, wherein said first end region, first intermediary region and second intermediary region are generally cylindrical in shape, said first end region being thicket than said first intermediary portion and said first intermediary portion being thicker than said second intermediary portion.

10. An apparatus for dissipating and discharging electric charge according to claim 4, wherein said body is flexible.

11. An apparatus for dissipating and discharging electric charge according to claim 4, wherein said body has a unitary construction.

12. An apparatus for dissipating and discharging electric charge according to claim 4, wherein said insulating layer is capable of withstanding a wide range of temperatures and atmospheric conditions.

13. The device of claim 4, wherein said first end region has a surface resistivity of at least about $10^5$ Ohms per square centimeter and said second end region has a surface resistivity of about $10^2$ Ohms per centimeter.

14. The device of claim 4, wherein said second end region is generally bulb shaped.

15. The device of claim 4, wherein said second end region comprises molded thermoplastic material.

16. An apparatus for dissipating and discharging electric charge from a mass which is not directly connected to ground, comprising:

a non-metallic body having a first end having a first conductivity attached to the mass and a second, bulbous end region having a second conductivity for facilitating the discharge of electric charge to the ambient atmosphere, the first conductivity being less than the second conductivity; and an insulating layer for enclosing exposed portions of said non-metallic body except for a portion of said second end region.

17. An apparatus for dissipating and discharging electric charge according to claim 16, wherein said nonmetallic body is composed of conductive plastic.

18. An apparatus for dissipating and discharging electric charge according to claim 17, wherein the conductive plastic is polypropylene, the polypropylene being loaded with a first quantity of carbon to obtain the first conductivity near the first end and a second quantity of carbon to obtain the second conductivity near the second end.

19. An apparatus for dissipating and discharging electric charge from an aircraft comprising:

an elongate body having a first end for interconnection to a trailing edge surface of said aircraft and a second free end which is exposed to the ambient atmosphere for discharge of electric charge thereto, said body including a first region having a surface resistivity of at least about $10^4$ Ohms per square centimeter and a second region having a surface resistivity of no greater than about $10^3$ Ohms per square centimeter, wherein said first region is closer to said first end than is said second region.

20. The apparatus of claim 19, wherein said first region has a surface resistivity between about $10^5$ and $10^6$ Ohms per square centimeter and said second region has a surface resistivity of about $10^2$ Ohms per square centimeter.

* * * * *